US007298358B2

(12) United States Patent
Honbo

(10) Patent No.: US 7,298,358 B2
(45) Date of Patent: Nov. 20, 2007

(54) LIQUID CRYSTAL DISPLAY AND DRIVING METHOD USED FOR SAME

(75) Inventor: Nobuaki Honbo, Kanagawa (JP)

(73) Assignee: NEC LCD Technologies, Ltd., Kawasaki-Shi, Kanagawa (JP)

( * ) Notice: Subject to any disclaimer, the term of this patent is extended or adjusted under 35 U.S.C. 154(b) by 597 days.

(21) Appl. No.: 10/944,969

(22) Filed: Sep. 21, 2004

(65) Prior Publication Data

US 2005/0062681 A1 Mar. 24, 2005

(30) Foreign Application Priority Data

Sep. 24, 2003 (JP) ..... 2003-332283

(51) Int. Cl.
*G09G 3/36* (2006.01)

(52) U.S. Cl. ..... 345/102; 345/87

(58) Field of Classification Search ..... 345/102, 345/87, 89, 100, 204
See application file for complete search history.

(56) References Cited

U.S. PATENT DOCUMENTS

| | | | | |
|---|---|---|---|---|
| 6,348,910 | B1 * | 2/2002 | Yamamoto et al. | 345/102 |
| 6,839,048 | B2 * | 1/2005 | Park | 345/102 |
| 6,980,225 | B2 * | 12/2005 | Funamoto et al. | 345/102 |
| 7,218,305 | B2 * | 5/2007 | Nose | 345/102 |

FOREIGN PATENT DOCUMENTS

| | | |
|---|---|---|
| JP | 2001-108962 | 4/2001 |
| JP | 2001-296841 | 10/2001 |

OTHER PUBLICATIONS

Korean Office Action dated Jun. 14, 2006 with Partial English Translation.

* cited by examiner

*Primary Examiner*—Kevin M. Nguyen
(74) *Attorney, Agent, or Firm*—McGinn IP Law Group, PLLC

(57) ABSTRACT

A liquid crystal display is provided which is capable of improving a quality of a displayed image made up of a moving image and a static image in a mixed manner. By arranging backlights and by dividing one frame of a video input signal into four frame blocks and by getting a moving image detecting circuit to judge whether an image for each of the frame blocks is a moving image or a static image and having a lighting timing duty control section get the backlight corresponding to an image for the frame block having been judged to be a moving image to flash and also get the backlight corresponding to an image for the frame block having been judged to be a static image to be turned ON all the time, occurrence in an image retention phenomenon or a blur of an edge is reduced when a moving image is to be displayed and occurrence of a flicker is eliminated when a static image is to be displayed, which enables improvements in a quality of a displayed image.

9 Claims, 6 Drawing Sheets

LIQUID CRYSTAL DISPLAY AND DRIVING METHOD USED FOR SAME

BACKGROUND OF THE INVENTION

1. Field of the Invention

The present invention relates to a liquid crystal display and a driving method to be used for the liquid crystal display and more particularly to the liquid crystal display that can be suitably used when an image including a moving image part and a static image part in a mixed manner is to be displayed and the method for driving the liquid crystal display.

The present application claims priority of Japanese Patent Application No. 2003-332283 filed on Sep. 24, 2003, which is hereby incorporated by reference.

2. Description of the Related Art

In recent years, a liquid crystal display, in particular, out of image display devices, has become large in size and high definition and is used not only for a device to display a static image such as images in a personal computer, word processor, or a like but also for a device to display a moving image such as images in a TV (television) or a like. It is anticipated that a penetration rate of a liquid crystal display in general homes, since its depth is shorter and its occupying area is smaller when compared with those in a TV having a CRT (Cathode Ray Tube), becomes high.

In the case of a liquid crystal display, since image data (pixel data) that appeared one frame before is left until new image data is written, an image retention phenomenon or a blur of an edge occurs when a moving image is to be displayed. To solve the problem with the phenomenon, a method in which a backlight is driven by an impulse is available, however, due to the driving method using the impulse, a flicker occurs on a display screen. The flicker is inconspicuous while a moving image is being displayed but becomes conspicuous while a static image is being displayed in some cases and, therefore, a liquid crystal display capable of suppressing the occurrence of a flicker is proposed.

Such the conventional technology is disclosed in, for example, Japanese Patent Application Laid-open No. 2001-296841 (Pages 11 and 14, and FIGS. 3 and 11.) FIG. 6 is a schematic diagram illustrating configurations of a conventional liquid crystal display disclosed in the above patent reference. The liquid crystal display, as shown in FIG. 6, is made up of a switching section 1, a high-speed switch 2, lamps 3*a* and 3*b*, a light guide section 4, and a liquid crystal panel 5. In the liquid crystal display device, whether an image to be displayed is a moving image or a static image is judged by a judging section (not shown) and, when the image to be displayed is a moving image, power is fed through the switching section 1 to the high-speed switch 2 and the lamps 3*a* and 3*b* operating as a backlight flash alternately during one frame of a video inputting signal. Then, light from the lamps 3*a* and 3*b* is diffused by the light guide section 4 to a direction of the liquid crystal panel 5 and is modulated in a manner to correspond to a display image on the liquid crystal panel 5 and is then emitted to a side of a display surface (screen). Moreover, when the image to be displayed is a static image, power is fed through the switching section 1 to the lamp 3*a* to allow the lamp 3*a* to be turned ON all the time. The light from the lamp 3*a* is diffused by the light guide section 4 to a direction of the liquid crystal panel 5 and is modulated in a manner to correspond to a display image on the liquid crystal panel 5 and is then emitted to the side of the display surface.

FIG. 7 is a schematic diagram illustrating configurations of another conventional liquid crystal display disclosed in the above patent reference. The liquid crystal display, as shown in FIG. 7, includes an image receiving section 11, a judging section 12, a sorting section 13, a switching section 14, and a display device 15. The display device 15 has a peripheral portion driving section 15*a*, a central portion driving section 15*b*, and a moving image corresponding control section 15*c*. The display surface (screen) of the display device 15, as shown in FIG. 8, has a display element section 16 making up its central portion and a display element section 17 making up its peripheral portion. An exclusive backlight (not shown) is formed on the display element section 16.

In the above liquid crystal display, image data output from the image receiving section 11 is sorted into two groups in the sorting section 13, one group being displayed in a peripheral portion of the display screen and another group being displayed in a central portion of the display screen and the image data to be displayed in the peripheral portion is transmitted via the switching section 14 to the peripheral portion driving section 15*a* of the display device 15 and the image data to be displayed in the central portion is transmitted via the switching section 14 to the central portion driving section 15*b* of the display device 15. Moreover, a judgement of whether the above image data is to be corresponded to a moving image or to a static image is made by the judging section 12 and, if the image data is to be corresponded to a moving image, the image data being displayed in the central portion having been sent out from the sorting section 13 is transmitted via the switching section 14 to the moving image corresponding control section 15*c* in the display device 15. The moving image corresponding control section 15*c* lets the sent-out image data be displayed on the display element section 16 making up the central portion on the display surface and turns on a backlight (not shown).

However, the conventional liquid crystal display devices described above have following problems. That is, in the liquid crystal display device shown in FIG. 6, when a moving image is to be displayed, the lamps 3*a* and 3*b* alternately flash during one frame and, at this point, while the lamps 3*a* and 3*b* are being lit, in the liquid crystal panel 5, liquid crystal cells whose responding operations to pixel data have been completed and liquid crystal cells whose responding operations to pixel data have not been completed exist, thus causing occurrence of a luminance inclination in the display screen. The brightness inclination becomes conspicuous as the liquid crystal panel 5 becomes large in size, which presents a problem in that a quality of a displayed image declines.

Moreover, the liquid crystal display device shown in FIG. 7 is fabricated on the premise that a moving image is displayed only in a center portion of the display screen and, therefore, lighting of the backlight (not shown) is performed in a manner to correspond to a static image in a peripheral portion of the display screen and, when a moving image is to be displayed in the peripheral portion of the display screen, an afterimage occurs, which presents a problem that a quality of the displayed image declines.

SUMMARY OF THE INVENTION

In view of the above, it is an object of the present invention to provide a liquid crystal display which is capable of reducing occurrence in an image retention phenomenon or a blur of an edge when a moving image is to be displayed and of eliminating occurrence of a flicker when a static image is to be displayed and of improving a quality of a displayed image including a moving image part and a static image part in a mixed manner.

According to a first aspect of the present invention, there is provided a liquid crystal display including a light source, two or more data electrodes formed at specified intervals in a first direction, two or more scanning electrodes formed at specified intervals in a second direction orthogonal to the first direction, and a liquid crystal panel having two or more liquid crystal cells each being formed at an intersecting region between each of the data electrodes and each of the scanning electrodes wherein pixel data is fed to each of the liquid crystal cells when a scanning signal is sequentially applied to each of the scanning electrodes and corresponding pixel data is fed to each of the data electrodes and wherein modulation on light supplied from the light source is performed in a manner to correspond to an image to be displayed, the liquid crystal display including:

the light source including two or more light source blocks being divided in the second direction of the liquid crystal panel;

an image judging unit (means) to divide one frame of a video input signal into two or more frame blocks each corresponding to a length of each of the light source blocks in the second direction and to judge whether an image corresponding to each of the frame blocks is a moving image or a static image; and a light source block driving unit (means) to allow one of the light source blocks corresponding to an image for the frame block having been judged to be a moving image to flash according to a response characteristic of each of the liquid crystal cells to feeding of the pixel data and to allow one of the light source blocks corresponding to an image for the frame block having been judged to be the static image to be turned ON all the time.

In the foregoing, a preferable mode is one wherein the light source block driving unit (means) is constructed so as to turn OFF a corresponding light source block before a responding operation of each of the liquid crystal cells to feeding of the pixel data is completed and so as to turn ON the corresponding light source block after the responding operation has been completed.

Also, a preferable mode is one wherein the image judging unit (means) detects, from the video input signal and for every frame block, a movement vector between a present frame image appearing continuously in terms of time and a prior frame image and sorts, based on the movement vector, the present frame image into a moving image and a static image for every frame block.

According to a second aspect of the present invention, there is provided a method for driving a light source to be used for a liquid crystal display having a light source, two or more data electrodes formed at specified intervals in a first direction, two or more scanning electrodes formed at specified intervals in a second direction orthogonal to the first direction, and a liquid crystal panel made up of two or more liquid crystal cells each being formed at an intersecting region between each of the data electrodes and each of the scanning electrodes wherein pixel data is fed to each of the liquid crystal cells when a scanning signal is sequentially applied to each of the scanning electrodes and corresponding pixel data is fed to each of the data electrodes and modulation on light supplied from the light source is performed in a manner to correspond to an image to be displayed, the light source including two or more light source blocks being divided in the second direction of the liquid crystal panel, the method including;

an image judging step of dividing one frame of a video input signal into two or more frame blocks each corresponding to a length of each of the light source blocks in the second direction and judging whether an image corresponding to each the frame block is a moving image or a static image; and a light source block driving step of allowing one of the light source block corresponding to an image for the frame block having been judged to be the moving image to flash according to a response characteristic of each of the liquid crystal cells to feeding of the pixel data and allowing one of the light source block corresponding to an image for the frame block having been judged to be the static image to be turned ON all the time.

In the foregoing, a preferable mode is one wherein, in the light source block driving step, the light source block is turned OFF before a responding operation of each liquid crystal cell to feeding of the pixel data is completed and the light source block is turned ON after the responding operation has been completed.

Also, a preferable mode is one wherein, in the image judging step, a movement vector is detected from the video input signal, for every frame block, between a present frame image appearing continuously in terms of time and a prior frame image and the present frame image is sorted, based on the movement vector, into the moving image and the static image, for every frame block.

With the above configuration, two or more light source blocks being divided in a second direction of the liquid crystal panel are arranged and one frame of a video input signal is divided into two or more frame blocks each corresponding to a length of the second direction of each of the light source blocks and an image judging section judges whether an image corresponding to each frame block is a moving image or a static image and a light source block driving section allows the light source block corresponding to an image for a frame block having been judged to be a moving image to flash according to a response characteristic of each liquid crystal cell to feeding of pixel data and also allows a backlight corresponding to an image for a frame block having been judged to be a static image to be turned ON all the time and, therefore, occurrence in an image retention phenomenon or a blur of an edge is reduced when a moving image is to be displayed and no flicker occurs when a static image is to be displayed, which enables improvements in a quality of a displayed image.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

Embodiment

In a liquid crystal display of the embodiment of the present invention, its light source is made up of two or more light source blocks being divided in a second direction (scanning direction) of a liquid crystal panel, in which the light source block corresponding to a region in which a moving image is displayed is made to flash according to a response characteristic of the liquid crystal panel.

Figure 1:
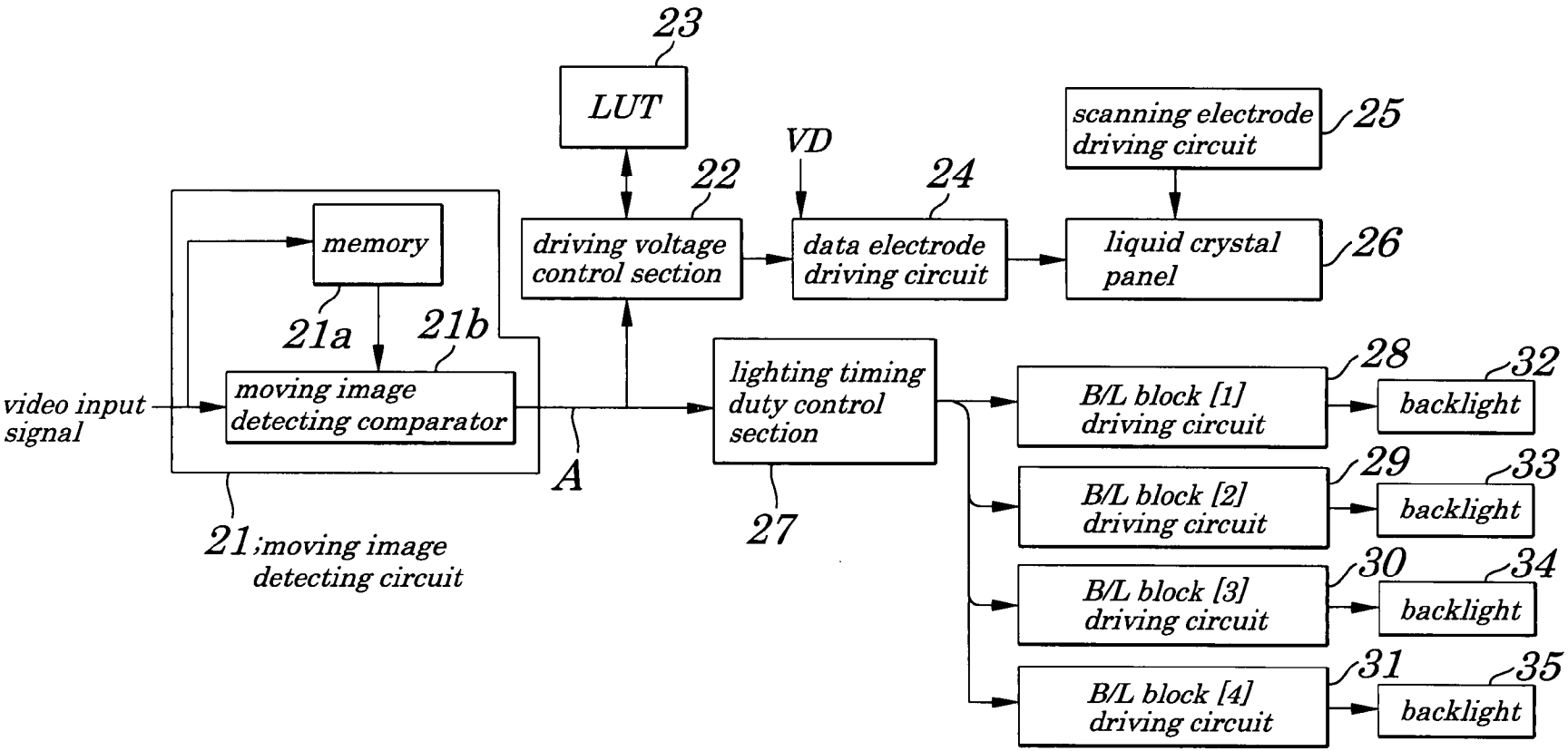
FIG. 1 is a schematic block diagram showing electrical configurations of a liquid crystal display of an embodiment of the present invention.

FIG. 1 is a schematic block diagram showing electrical configurations of the liquid crystal display of the embodiment of the present invention. The liquid crystal display of the embodiment, as shown in FIG. 1, includes a moving image detecting circuit 21, a driving voltage control section 22, an LUT (Look Up Table) 23, a data electrode driving circuit 24, a scanning electrode driving circuit 25, a liquid crystal panel 26, a lighting timing duty control section 27, a B/L (Backlight) block [1] driving circuit 28, a B/L block [2] driving circuit 29, a B/L block [3] driving circuit 30, a B/L block [4] driving circuit 31, and backlights 32, 33, 34, and 35. Each of the backlights 32, 33, 34, and 35 is divided in a scanning direction of the liquid crystal panel 26.

The moving image detecting circuit 21 has a memory 21*a* and a moving image detecting comparator 21*b*. The memory 21*a* is made up of, for example, a RAM (Random Access Memory) or a like and stores a video input signal VD for every frame. The moving image detecting comparator 21*b* divides one frame of the video input signal VD into four frame blocks each corresponding to a length of each of the backlights 32, 33, 34, and 35 in the scanning direction, and judges whether an image corresponding to each of the frame blocks is a moving image or a static image and outputs its judgement result A. Especially, in the embodiment, the moving image detecting comparator 21*b* detects, from the video input signal VD and for every frame block, a movement vector between a present frame image appearing continuously in terms of time and a prior frame image being stored in the memory 21*a* and sorts, based on the movement vector, the present frame image into a moving image and a static image for every flame block.

The driving voltage control section 22 controls, based on the judgement result A, a voltage to be used for the data electrode driving circuit 24 to drive each liquid crystal cell $\mathbf{42}_{i,j}$ (shown in FIG. 2) in the liquid crystal panel 26 in an overshooting manner. In the LUT 23, data on a voltage to be used for the overshoot driving that can be used suitably to display a moving image, and data on the voltage that can be used suitably to display a static image are stored. The lighting timing duty control section 27 is made up of two or more logical circuits or a like and outputs, based on the judgement result A, a control signal to get a backlight corresponding to an image for a frame block having been judged to be a moving image to flash according to a response characteristic of each liquid crystal cell $\mathbf{42}_{i,j}$ in the liquid crystal panel 26 to feeding of image data (pixel data) and also a control signal to allow a backlight 32, 33, 34, or 35 corresponding to an image for a frame block having been judged to be a static image to be turned ON all the time. In the embodiment in particular, the lighting timing duty control section 27 turns OFF the backlight before a responding operation of each liquid crystal cell $\mathbf{42}_{i,j}$ to feeding of image data is not completed and turns ON the backlight after the responding operation has been completed.

The B/L block [1] driving circuit 28 is made up of, for example, an inverter or a like and drives the backlight 32 based on a control signal output from the lighting timing duty control section 27. The inverter rectifies power from a commercial power source to produce a direct current and further generates a high frequency of about 45 kHz to turn ON the backlight 32 using a high-frequency stabilizer (not shown). Similarly, the B/L block [2] driving circuit 29, B/L block [3] driving circuit 30, and B/L block [4] driving circuit 31 drive the backlights 33, 34, and 35 respectively. Each of the backlights 32, 33, 34, and 35 is made up of, for example, a cold cathode fluorescent tube and a light guide plate to diffuse light from the cold cathode fluorescent tube to use the diffused light as light from a flat light source, or a like.

Figure 2:
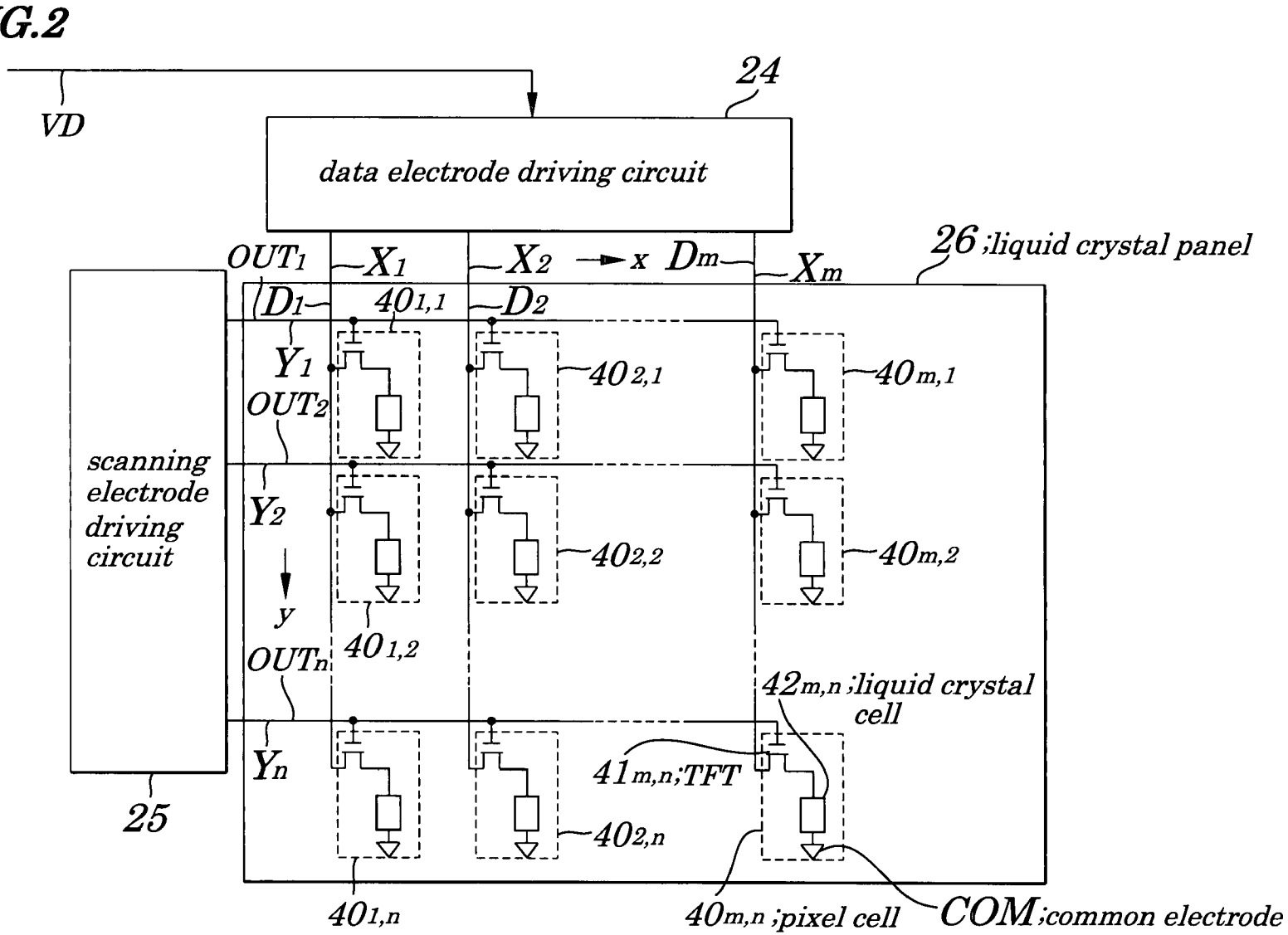
FIG. 2 is a diagram showing one example of a liquid crystal panel shown in FIG. 1.

FIG. 2 is a diagram showing one example of the liquid crystal panel 26 shown in FIG. 1. The liquid crystal panel 26, as shown in FIG. 2, is made up of data electrodes $X_i$ (i=1, 2, . . . , m; for example, m=640×3), scanning electrodes $Y_j$(j=1, 2, . . . , n; for example, n=512), and pixel cells $\mathbf{40}_{i,j}$. The data electrodes $X_i$ are formed at specified intervals in an "x" direction (that is, first direction), to which a voltage corresponding to pixel data $D_i$ is applied. The scanning electrodes $Y_j$ are formed at specified intervals in a "y" direction (that is, scanning direction or second direction) orthogonal to the "x" direction, to which a scanning signal $OUT_j$ used to write pixel data $D_i$ is sequentially fed. Each of the pixel cells $\mathbf{40}_{i,j}$ is formed in a one-to-one relationship to an intersecting region between each of the data electrodes $X_i$ and each of the scanning electrodes $Y_j$ and is made up of a TFT (Thin Film Transistor) $\mathbf{41}_{i,j}$, a liquid crystal cell $\mathbf{42}_{i,j}$, and a common electrodes COM. The TFT $\mathbf{41}_{i,j}$ is controlled ON and OFF based on a scanning signal $OUT_j$ and applies, when being put in an ON state, a voltage corresponding to the pixel data $D_i$ to the liquid crystal cell $\mathbf{42}_{i,j}$. In the liquid crystal panel 26, when a scanning signal $OUT_j$ is sequentially fed to the scanning electrodes $Y_j$ and the corresponding pixel data $D_i$ is fed to the data electrodes $X_i$, the corresponding pixel data $D_i$ is fed to each liquid crystal cell $\mathbf{42}_{i,j}$ and modulation is performed on light fed from the backlights 32, 33, 34, and 35 in a manner to correspond to an image to be displayed. The data electrode driving circuit 24 applies, based on image data VD, a voltage corresponding to the pixel data $D_i$ to each of the data electrodes $X_i$. The scanning electrode driving circuit 25 feeds a scanning signal $OUT_j$ sequentially to each of the scanning electrodes $Y_j$.

Figure 3:
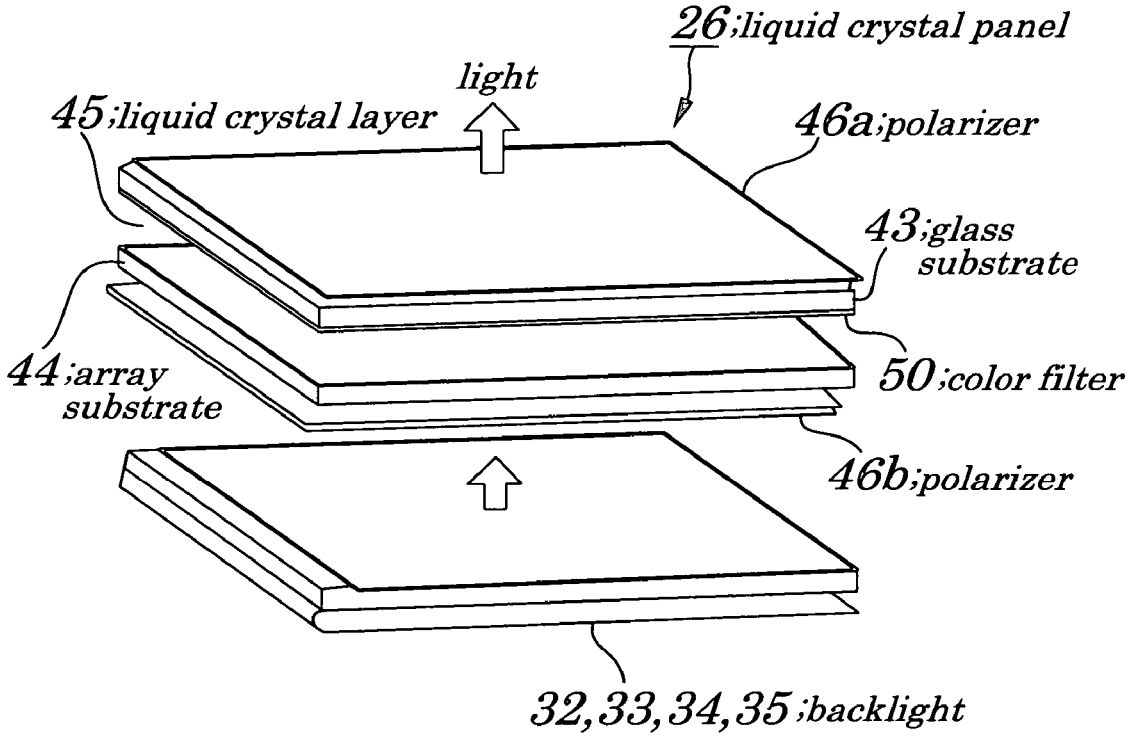
FIG. 3 is a diagram schematically illustrating configurations of the liquid crystal panel shown in FIG. 1 and showing positions of backlights shown in FIG. 1.
Figure 4:
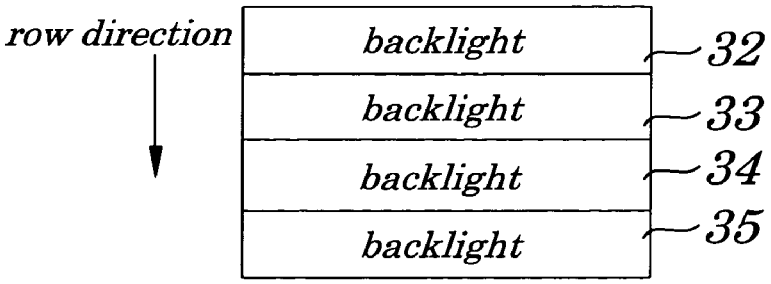
FIG. 4 is a diagram showing configurations of the backlights shown in FIG. 3.

FIG. 3 is a diagram schematically illustrating configurations of the liquid crystal panel 26 shown in FIG. 1 and showing positions of backlights 32, 33, 34, and 35 shown in FIG. 1. The liquid crystal panel 26, as shown in FIG. 3, includes a pair of polarizers 46*a* and 46*b*, a glass substrate 43, an array substrate 44, and a liquid crystal layer 45 interposed between the glass substrate 43 and the array substrate 44. On the glass substrate 43 is formed a color filter 50 having red (R), green (G), and blue (B) colors, in which one dot is made up of three pixels, one emitting an R color, another emitting a G color, and another emitting a B color. The array substrate 44 is a glass substrate on which active elements such as the TFT $\mathbf{41}_{i,j}$ (in FIG. 2) or a like are formed. The backlights 32, 33, 34, and 35 are arranged on a rear side of the liquid crystal panel 26 and use light from a white fluorescent lamp as light from the flat light source. The backlights 32, 33, 34, and 35, as shown in FIG. 4, are fabricated so as to be almost the same in size as the display screen of the liquid crystal panel 26 and to be divided in a scanning direction of the liquid crystal panel 26.

In the liquid crystal panel 26, white light from the backlights 32, 33, 34, and 35 becomes linearly polarized light after having passed through the polarizer 46*b* and then enters the liquid crystal layer 45. The liquid crystal layer 45 has a function of changing a shape of the polarized light, however, this function is predetermined by a state of an orientation of a liquid crystal and therefore the shape of the polarized light is controlled by a voltage corresponding to pixel data $D_i$. Whether or not light to be emitted is adsorbed by the polarizer 46*b* is determined depending on a shape of the polarized light emitted from the liquid crystal layer 45. Thus, transmittance of light is controlled by a voltage corresponding to the pixel data $D_i$. Moreover, a color image can be obtained by additive color mixture of light having passed through each of the R, G, and B pixels in the color filter 50.

Figure 5:
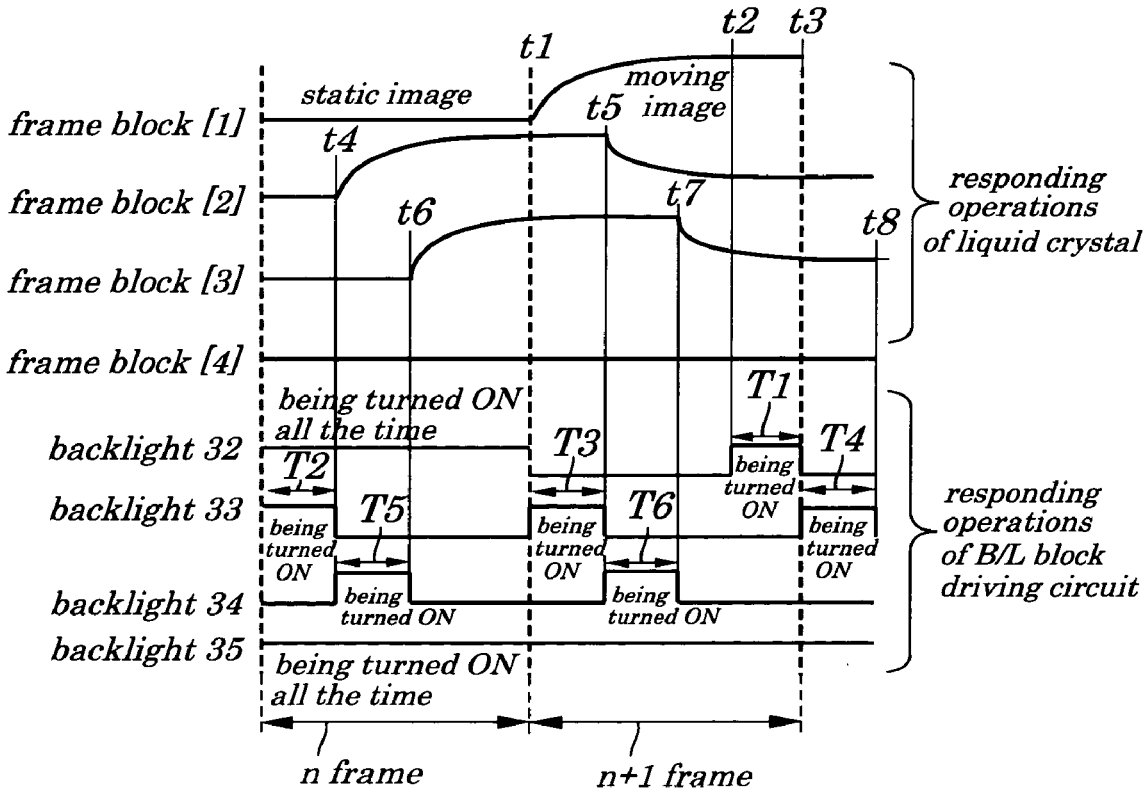
FIG. 5 is a time chart explaining operations of the liquid crystal display shown in FIG. 1.
Figure 6:
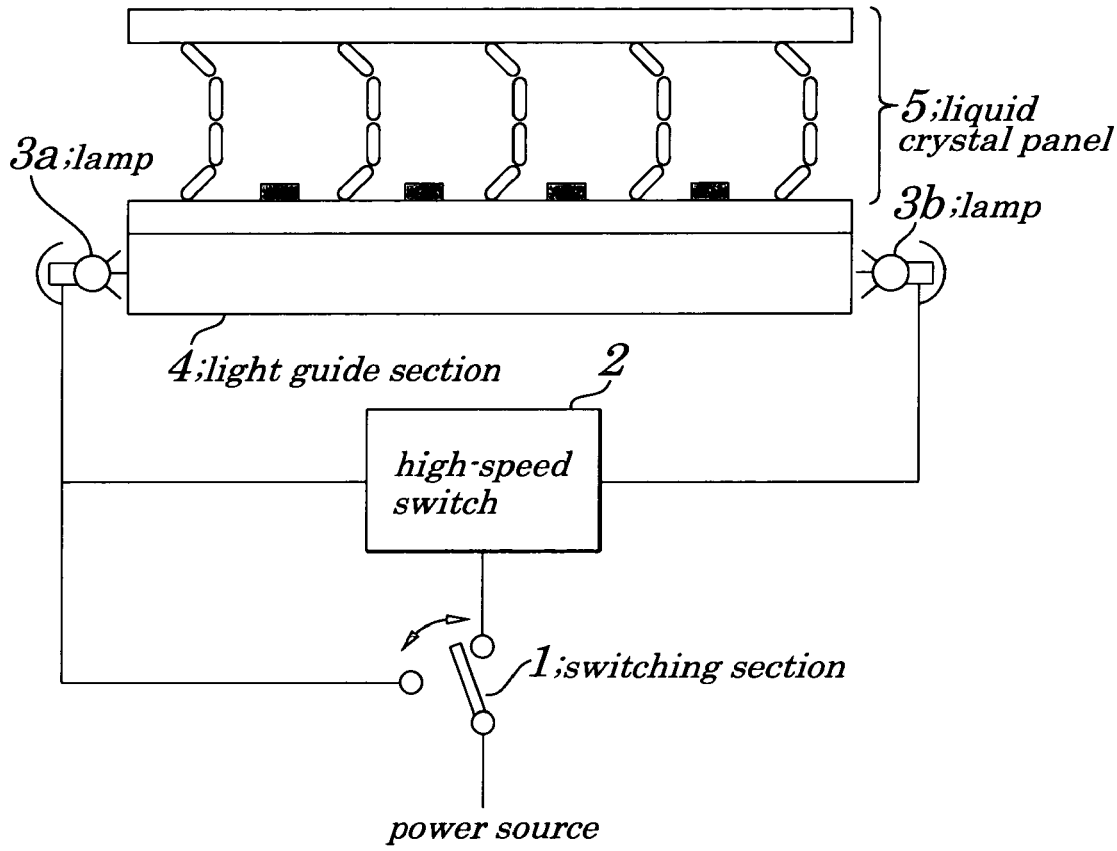
FIG. 6 (PRIOR ART)
FIG. 6 is a schematic diagram illustrating configurations of a conventional liquid crystal display.
Figure 7:
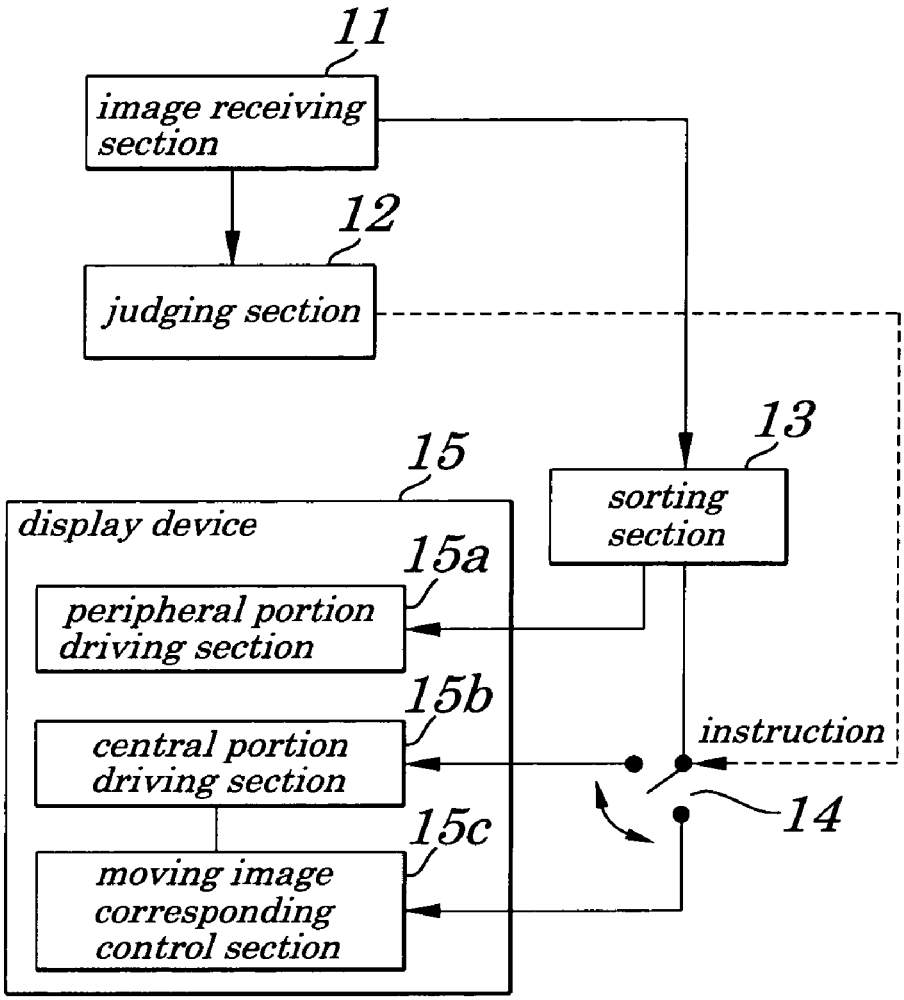
FIG. 7 (PRIOR ART)
FIG. 7 is a schematic diagram illustrating configurations of another conventional liquid crystal display.
Figure 8:
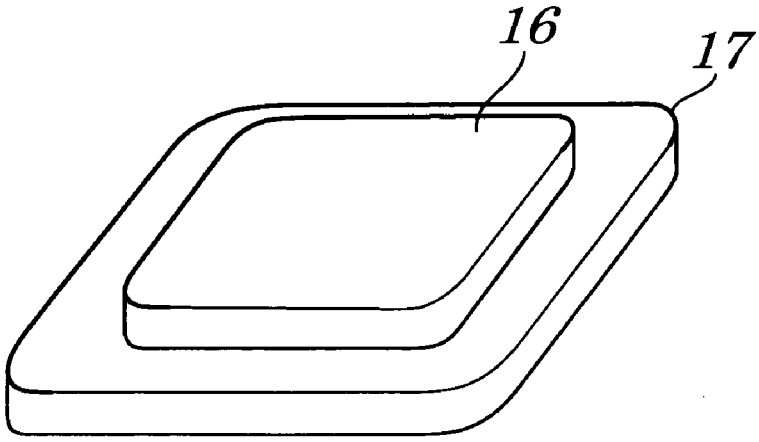
FIG. 8 (PRIOR ART)
FIG. 8 is a diagram illustrating configurations of a display surface of the conventional liquid crystal display shown in FIG. 7.

FIG. 5 is a time chart explaining operations of the liquid crystal display shown in FIG. 1. A driving method to be used in the liquid crystal display is described by referring to FIG. 5. A video input signal VD is stored in the memory 21*a* for every frame. The video input signal VD is divided by the moving image detecting comparator 21*b* into four frame blocks [1], [2], [3], and [4] each corresponding to a length of each of the backlights 32, 33, 34, and 35 in a scanning direction. Then, a movement vector between a present frame image of an image appearing continuously in terms of time and a prior frame image being stored in the memory 21*a* is detected from the video input signal VD in every frame block and whether the present frame image is a moving image or a static image is judged based on the movement vector for every frame block, and the judgement result A is output (image judging process).

The judgement result A is input to the driving voltage control section 22 which controls, based on the judgement result A and data being stored in the LUT 23, a voltage to be used for the data electrode driving circuit 24 to drive the liquid crystal cell $\mathbf{42}_{i,j}$ in the liquid crystal panel 26 in an overshooting manner. Moreover, the video input signal VD is input to the data electrode driving circuit 24 from which a voltage corresponding to pixel data $D_i$ is applied to each of the data electrodes $X_i$ in the liquid crystal panel 26. This voltage is controlled by the driving voltage control section 22 so that it has a voltage being suitable to overshooting driving. Also, a scanning signal $OUT_j$ is applied sequentially from the scanning electrode driving circuit 25 to each of the scanning electrodes $Y_j$ in the liquid crystal panel 26.

On the other hand, the judgement result A is input to the lighting timing duty control section 27 which outputs a signal to get a backlight (one of 32, 33, 34, 35) corresponding to an image for a frame block having been judged to be a moving image to flash according to a response characteristic of the liquid crystal cell $\mathbf{42}_{i,j}$ to feeding of pixel data $D_i$ and a signal to get a backlight (one of 32, 33, 34, 35) corresponding to an image for a frame block having been judged to be a static image to be turned ON all the time. These signals are input to the B/L block [1] driving circuit 28, B/L block [2] driving circuit 29, B/L block [3] driving circuit 30, and B/L block [4] driving circuit 31 and the backlights 32 33, 34, and 35 are driven respectively (light source block driving process). At this point, the backlight is turned OFF before a responding operation of the liquid crystal cell $\mathbf{42}_{i,j}$ to the feeding of the pixel data $D_i$ is not completed and the backlight 32, 33, 34, or 35 is turned ON after the responding operation has been completed.

For example, as shown in FIG. 5, when an image corresponding to the frame block [1] is judged to be a static image during an "n" frame in a video input signal VD and to be a moving image during a "n+1" frame, the backlight 32 is turned ON all the time during the "n" frame. During a period of the "n+1" frame, the backlight is turned OFF at time t1 and, at the same time, a responding operation of the liquid crystal cell $\mathbf{42}_{i,j}$ corresponding to the frame block [1] starts. The responding operation of the liquid crystal cell $\mathbf{42}_{i,j}$ is completed at time t2 and the backlight 32 is turned ON during a period of T1 (for example, during a period of ¼ frames) from the time t2 to the time t3.

When an image corresponding to the frame block [2] is judged to be a moving image during the "n" frame and "n+1" frame of the video input signal VD, the backlight 33 that was turned ON during a period of T2 (for example, during a period of ¼ frames) is turned OFF at time t4 and a responding operation of the liquid crystal cell $\mathbf{42}_{i,j}$ corresponding to the frame block [2] is started. The responding operation of the liquid crystal cell $\mathbf{42}_{i,j}$ is completed at time t1 and the backlight 33 is turned ON during T3 (for example, during a period of ¼ frames) from time t1 to time t5. The backlight 33 that was turned ON during the period of T3 is turned OFF at time t5 and a responding operation of the liquid crystal cell $\mathbf{42}_{i,j}$ corresponding to the frame block [2] is started. At time t3, the responding operation of the liquid crystal cell $\mathbf{42}_{i,j}$ is completed and, during a period of T4 (for example, during a period of ¼ frame) from time t3 to time t8, the backlight 33 is turned ON.

Similarly, when an image corresponding to the frame block [3] is judged to be a moving image during the "n" frame and "n+1" frame of the video input signal VD, the backlight 34 that was turned ON during a period of T5 (for example, during a period of ¼ frame) is turned OFF at time t6 and, at the same time, a responding operation of the liquid crystal cell $\mathbf{42}_{i,j}$ corresponding to the frame block [3] is started. The responding operation of the liquid crystal cell $\mathbf{42}_{i,j}$ is completed at time t5 and the backlight 34 is turned ON during T6 (for example, during a period of ¼ frame) from time t5 to time t7. The backlight 34 that was turned ON during the period of T6 is turned OFF at time t7 and a responding operation of the liquid crystal cell $\mathbf{42}_{i,j}$ corresponding to the frame block [3] is started. At time t8, the responding operation of the liquid crystal cell $\mathbf{42}_{i,j}$ is completed.

When an image corresponding to the frame block [4] is judged to be a static image during the "n" frame and "n+1" frame in the video input signal VD, the backlight 35 is turned ON all the time.

Thus, in the above embodiment, by arranging backlights 32, 33, 34, and 35 being divided in a scanning direction of the liquid crystal panel 26 and by dividing one frame of a video input signal VD into four frame blocks [1], [2], [3], and [4] each corresponding to a length of each of the backlights 32, 33, 34, and 35 in the scanning direction, and by having the moving image detecting circuit 21 judge whether an image corresponding to each of the frame blocks [1], [2], [3], and [4] is a moving image or a static image and having the lighting timing duty control section 27 get the backlight corresponding to an image for the frame block having been judged to be a moving image to flash according to a response characteristic of each liquid crystal cell $\mathbf{42}_{i,j}$ to feeding of pixel data $D_i$ and also allow a backlight corresponding to an image for the frame block having been judged to be a static image to be turned ON all the time, occurrence in an image retention phenomenon or a blur of an edge is reduced when a moving image is to be displayed and no flicker occurs when a static image is to be displayed, which enables improvements in a quality of a displayed image.

It is apparent that the present invention is not limited to the above embodiments but may be changed and modified without departing from the scope and spirit of the invention. For example, in the above embodiment, the present invention is applied to transmittance-type liquid crystal panel, however, the present invention may be applied to a reflection-type liquid crystal panel. That is, by arranging four light guide bodies being divided in a scanning direction (equal to an arrangement direction of the backlights 32, 33, 34, and 35) on a side of a display surface of the liquid crystal panel as in the case of the embodiment and by installing a light source such as a cold cathode fluorescent tube on a light incident side of each of the light guide bodies and a reflection plate on a rear side of the liquid crystal panel, the same effects obtained in the embodiment can be achieved. In the above embodiment, the backlights 32, 33, 34, and 35 are made up of the cold cathode fluorescent tube, however, any component, so long as a needed amount of light is obtained, such as an LED (Light Emitting Diode), EL (Electroluminescent device), or a like may be used. Moreover, in the embodiment, for example, in FIG. 5, each of the periods of T1 to T6 is set to be a ¼ frame, however, so long as a period is one during which a responding operation of a liquid crystal cell $\mathbf{42}_{i,j}$ has been completed, the period may be set to be not only a ¼ frame but also a ½ frame. When the ½ frame is employed, to obtain the same brightness as can be acquired when the period is set to be the ¼ frame, the amount of light is set to be ½.

What is claimed is:

1. A liquid crystal display comprising a light source, two or more data electrodes formed at specified intervals in a first direction, two or more scanning electrodes formed at specified intervals in a second direction orthogonal to said first direction, and a liquid crystal panel having two or more liquid crystal cells each being formed at an intersecting region of any one of said data electrodes and any one of said scanning electrodes wherein pixel data is fed to each of said liquid crystal cells when a scanning signal is sequentially applied to each of said scanning electrodes and corresponding pixel data is fed to each of said data electrodes and wherein modulation on light supplied from said light source is performed in a manner to correspond to an image to be displayed, said liquid crystal display comprising:

said light source comprising two or more light source blocks being divided in said second direction of said liquid crystal panel;

an image judging unit to divide one frame of a video input signal into two or more frame blocks each corresponding to a length of each of said light source blocks in said second direction and to judge whether an image corresponding to each of said frame blocks is a moving image or a static image; and a light source block driving unit to allow one of said light source blocks corresponding to an image for said frame block having been judged to be a moving image to flash according to a response characteristic of each of said liquid crystal cells to feeding of said pixel data and to allow one of said light source blocks corresponding to an image for said frame block having been judged to be said static image to be turned ON all the time.

2. The liquid crystal display according to claim 1, wherein said light source block driving unit is constructed so as to turn OFF a corresponding light source block before a responding operation of each of said liquid crystal cells to feeding of said pixel data is completed and so as to turn ON said corresponding light source block after said responding operation has been completed.

3. The liquid crystal display according to claim 1, wherein said image judging unit detects, from said video input signal and for every said frame block, a movement vector between a present frame image appearing continuously in terms of time and a prior frame image and sorts, based on said movement vector, said present frame image into said moving image and said static image for every frame block.

4. A liquid crystal display comprising a light source, two or more data electrodes formed at specified intervals in a first direction, two or more scanning electrodes formed at specified intervals in a second direction orthogonal to said first direction, and a liquid crystal panel having two or more liquid crystal cells each being formed at an intersecting region of any one of said data electrodes and any one of said scanning electrodes wherein pixel data is fed to each of said liquid crystal cells when a scanning signal is sequentially applied to each of said scanning electrodes and corresponding pixel data is fed to each of said data electrodes and wherein modulation on light supplied from said light source is performed in a manner to correspond to an image to be displayed, said liquid crystal display comprising:

said light source comprising two or more light source blocks being divided in said second direction of said liquid crystal panel;

an image judging means to divide one frame of a video input signal into two or more frame blocks each corresponding to a length of each of said light source blocks in said second direction and to judge whether an image corresponding to each of said frame blocks is a moving image or a static image; and a light source block driving means to allow one of said light source blocks corresponding to an image for said frame block having been judged to be a moving image to flash according to a response characteristic of each of said liquid crystal cells to feeding of said pixel data and to allow one of said light source blocks corresponding to an image for said frame block having been judged to be said static image to be turned ON all the time.

5. The liquid crystal display according to claim 4, wherein said light source block driving means is constructed so as to turn OFF a corresponding light source block before a responding operation of each of said liquid crystal cells to feeding of said pixel data is completed and so as to turn ON said corresponding light source block after said responding operation has been completed.

6. The liquid crystal display according to claim 4, wherein said image judging means detects, from said video input signal and for every said frame block, a movement vector between a present frame image appearing continuously in terms of time and a prior frame image and sorts, based on said movement vector, said present frame image into said moving image and said static image for every frame block.

7. A method for driving a light source to be used for a liquid crystal display having a light source, two or more data electrodes formed at specified intervals in a first direction, two or more scanning electrodes formed at specified intervals in a second direction orthogonal to said first direction, and a liquid crystal panel made up of two or more liquid crystal cells each being formed at an intersecting region of any one of said data electrodes and any one of said scanning electrodes wherein pixel data is fed to each of said liquid crystal cells when a scanning signal is sequentially applied to each of said scanning electrodes and corresponding pixel data is fed to each of said data electrodes and modulation on light supplied from said light source is performed in a manner to correspond to an image to be displayed, said light source comprising two or more light source blocks being divided in said second direction of said liquid crystal panel, said method comprising;

an image judging step of dividing one frame of a video input signal into two or more frame blocks each corresponding to a length of each of said light source blocks in said second direction and judging whether an image corresponding to each said frame block is a moving image or a static image; and a light source block driving step of allowing one of said light source block corresponding to an image for said frame block having been judged to be said moving image to flash according to a response characteristic of each of said liquid crystal cells to feeding of said pixel data and allowing one of said light source block corresponding to an image for said frame block having been judged to be said static image to be turned ON all the time.

8. The method for driving the light source according to claim 7, wherein, in said light source block driving step, said light source block is turned OFF before a responding operation of each liquid crystal cell to feeding of said pixel data is completed and said light source block is turned ON after said responding operation has been completed.

9. The method for driving the light source according to claim 7, wherein, in said image judging step, a movement vector is detected from said video input signal, for every said frame block, between a present frame image appearing continuously in terms of time and a prior frame image and said present frame image is sorted, based on said movement vector, into said moving image and said static image, for every said frame block.

* * * * *